United States Patent [19]

Bracewell

[11] Patent Number: 4,942,932

[45] Date of Patent: Jul. 24, 1990

[54] AUGER DRILLING SYSTEM

[76] Inventor: Ross W. Bracewell, 5060 Chestnut Street, Pierrefonds (Montreal), Quebec, Canada

[21] Appl. No.: 302,917

[22] Filed: Jan. 30, 1989

[51] Int. Cl.[5] ..... E21B 17/22
[52] U.S. Cl. ..... 175/323; 175/394
[58] Field of Search ..... 175/323, 394; 299/87

[56] References Cited

U.S. PATENT DOCUMENTS

| | | | |
|---|---|---|---|
| 2,250,671 | 7/1941 | Joy | 175/323 X |
| 2,352,412 | 6/1944 | Sandstone | 175/323 |
| 3,318,397 | 5/1967 | Combes | 175/323 |
| 3,391,544 | 7/1968 | Daczko | 175/394 X |
| 4,484,642 | 11/1984 | Evans . | |

FOREIGN PATENT DOCUMENTS

| | | | |
|---|---|---|---|
| 659104 | 3/1963 | Canada | 255/33 |
| 2132667 | 7/1984 | United Kingdom . | |
| 2132668 | 7/1984 | United Kingdom . | |
| 2137678 | 10/1984 | United Kingdom . | |

*Primary Examiner*—William P. Neuder
*Attorney, Agent, or Firm*—Burke-Robertson

[57] ABSTRACT

An auger for use in drilling into the earth under rotative movement in one direction of rotation, the auger having a cylindrical stem and a helical flight extending along the length of the stem, the helical flight being defined by adjacent segments of opposite flight orientation. The auger of the present invention enables the drilling of fast holes of any conventional size to any conventional depth required in overburden and bedrock. It reduces the tendency of bore hole wall collapse through the use of bore hole material to stabilize the hole and reduces the amounts of drilling muds needed.

19 Claims, 1 Drawing Sheet

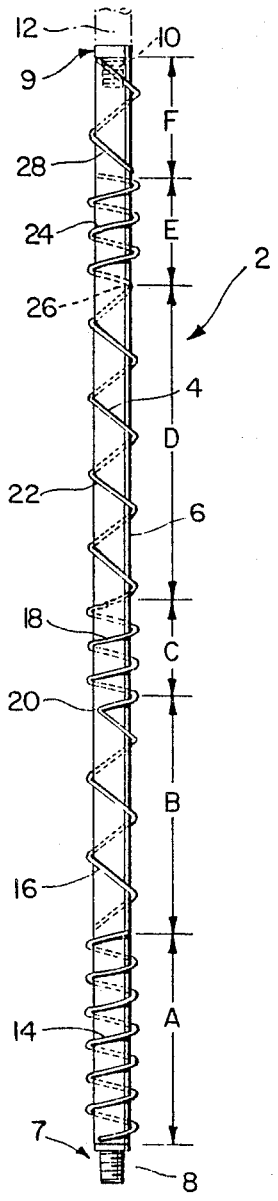
12
10
9
F
28
E
24
2
26
4
D
22
6
18
C
20
B
16
A
14
7
8

AUGER DRILLING SYSTEM

BACKGROUND OF THE INVENTION

The present invention relates to an improved auger for drilling into the earth.

The mechanical advantage of the lever has been utilized in augers for drilling for centuries. Typically, an auger drill rod that is rotated in a clockwise manner has affixed to it a flight with its helix also oriented in the clockwise or right hand direction. While the drill stem is rotated constantly in a clockwise manner, the helical flighting on such an auger lifts tailings away from the drill bit and tends to bring them to the surface as the auger is pulled down into the earth.

When drilling bore holes for seismic exploration or when drilling deeper holes, a drill string is conventionally used, made up of a plurality of lengths of drill steel which is usually hollow along its length. In auger drilling, the flight is spirally wound and secured to the exterior cylindrical surface of the drill steel. Water and drilling muds are forced under pressure downwardly through the drill string to the drill bit secured to the down hole end of the lower most drill steel so as to lubricate and cool the drill bit and help carry the tailings upwardly to the surface.

Auger drilling is recognized as comparatively fast. However, because of the very nature of the standard auger, the depth to which it can be utilized in drilling is limited.

The flighting of the auger is designed to lift the tailings and water mixture produced at the bit away from the bit and up to the surface.

As the hole gets deeper, the weight of the tailings being lifted decreases the torque that is able to be delivered at the drill bit. There is the increasing possibility in this instance that the material being lifted will clog the auger or that the bore hole wall may collapse around the auger. If a standard auger is rotated in a clockwise direction when trapped in a hole, it will only pull itself deeper into the bore hole. Reversing the direction of the rotation, on the other hand, will only disconnect the lengths of drill steel above the trapped length(s) of drill steel.

The only alternative of lifting the auger for cleaning becomes progressively more difficult as the hole becomes deeper. Auger drilling therefore has been limited to use in shallow depths such as required for seismic exploration and post holes for construction.

A reverse action auger has been described and illustrated in U.S. Pat. No. 4,484,642 of Evans issued Nov. 27, 1984. In this case, the auger is rotated as well in a clockwise manner but it has affixed to it a flight with its helix oriented in the left hand counterclockwise direction. Theoretically, the operation of such an auger creates a back (down hole) pressure that forces the tailings and mud created by the drill bit into the natural fissures, cracks or porous zones of the surrounding earth, so that nothing reaches the surface. Such a reverse action auger appears to work well when drilling in certain porous materials as are encountered in shallow seismic holes although the restraining of the flow of tailings away from the bit does result in excessive wear on the bit. When drilling in consolidated materials however, there is very seldom any place for tailings and water to go but up to the surface. In this instance, the continuous reverse action auger is a serious hindrance in that it continually forces material down the hole while the bit is producing more tailings. The deeper the hole, the more serious the problem. As well, with no upward movement of water and in fact a downward movement of the flighted auger all the way from the surface, a self-imposed jamming of the drill stem with dry material above the drill bit may result. This is especially hazardous in deep holes.

For drilling deep holes or drilling in materials where an auger would have difficulty because of the potential of bore hole wall collapse e.g. in sandy or very soft soils), conventional rotary drilling, as it is called, utilizes a smooth stem drill rod that is usually not much smaller in diameter than the drill bit that precedes its descent into the bore hole. The tailings or cuttings are brought to the surface by the action of the water and special drilling muds that are forced under pressure through the drill stem to both cool and lubricate the bit and then mix with the tailings. The drill bit is rotated at different speeds depending on the material being drilled. It is not unusual when drilling with this system, in certain difficult circumstances, to force casing slightly larger than the bit down the hole behind the drill bit, thus casing the hole as it is drilled and preventing bore hole wall collapse.

Traditionally, therefore, auger drilling, although recognized as a faster method of drilling, has been limited to shallow holes whereas conventional rotary drilling, although able to drill deeper, is a slower method of drilling.

Other patents of general background interest, relating to the present invention, are Canadian Pat. No. 659,104 of Sokjer-Petersen issued Mar. 12, 1963, British Pat. No. 2,132,667 of Shekisan Kogyo Co. Ltd., British Pat. No. 2,137,678 of Kabushiki Kaisha Matsuzawa Kiko, and British Pat. No. 2,132,668 of Shekisan Kogyo Co. Ltd..

It is an object of the present invention to provide an auger which overcomes the drawbacks associated with both auger drilling and conventional rotary drilling, thus enabling a system incorporating such new auger to be able drill quickly holes of any conventional size to any conventional depth. It is a further object of the present invention to provide such an auger which is not dependent, for its ability to operate, on the porosity of the walls of the drill hole. It is a further object of the present invention to provide an auger which will reduce the tendency of bore hole walls to collapse while at the same time reducing the amount of drilling muds needed when compared to traditional drilling systems.

SUMMARY OF THE INVENTION

In accordance with the present invention there is provided an auger for use in drilling into the earth under rotative movement in one direction of rotation. The auger has a cylindrical stem and a helical flight which extends along the length of the stem. The helical flight is defined by adjacent segments of opposite flight orientation.

It is preferred that the flighting be broken 180° where it switches from one direction to the other, and joined to form a wedge in the direction of rotation when it switches from the other direction back to the first, and that the flighting alternate, along the length of the auger stem, several times between right and left hand directions in a manner which will be defined in more detail hereinafter. Where the auger is intended for clockwise rotation, the flighting alternates from a right hand flight to a left hand flight a plurality of times from the bottom of the auger to its top. As well, it is preferred that the angle of the flight with respect to the axis of the stem be distinctly sharper where the flight is oriented in a direction opposite to the intended direction of rotation of the auger, than the angle of the flight which is oriented in a direction similar to the intended direction of rotation of the auger.

The auger designed in accordance with the present invention overcomes the drawbacks associated with both auger drilling and conventional rotary drilling, enabling systems incorporating this auger to be able to drill fast holes of any conventional size to any conventional depth required in overburden and bedrock. For reasons which will be described in more detail hereinafter, the auger in accordance with the present invention reduces the tendency of bore hole wall collapse through the use of bore hole material to stabilize the hole, when drilling through porous and unconsolidated material. It also reduces the amount of drilling muds needed. By maintaining certain balances between the flow rate of the drilling fluid and the rate of penetration of the drill bit when drilling through overburden, the amount of return to the surface may be controlled.

As well, when a hole is drilled through overburden into bedrock, there are additional advantages to the auger of the present invention. The same system incorporating such auger, which while penetrating will first seal the wall of the bore hole in the overburden, can be used to continue the drilling into the bedrock. The drilling muds which are needed to lift the tailings to the surface are not impeded by the specially designed auger but are limited from polluting the overburden because of the previous work of the auger. On the surface these muds can be captured in a mud tank and recirculated down the hole.

The auger in accordance with the present invention makes speed and depth limitations in drilling simply dependent upon the ability of the drill bit being used to penetrate the formation being drilled. If the formation consists of porous matter, the auger of the present invention will remove it from the drill bit as fast as the bit can penetrate and displace it into the wall, thereby stabilizing the bore wall. In this manner the auger of the present invention almost eliminates bore hole wall collapse, even when drilling in sand and very soft soil.

BRIEF DESCRIPTION OF THE DRAWINGS

These and other objects and advantages of the invention will become apparent upon reading the following detailed description and upon referring to the drawing in which:

FIG. 1 is an elevation, schematic view of an auger in accordance with the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

Turning to FIG. 1, there is illustrated a schematic view of an auger 2 in accordance with the present invention, for use in drilling into the earth under rotative movement in one direction or the other.

In particular, auger 2 comprises flights 4 helically wound, in a manner which will be described in more detail hereinafter, about a cylindrical stem 6, the flight 4 being defined by adjacent segments of opposite flight orientation. Stem 6 is made from any appropriate sized tubing, e.g. three inch tubing, having a wall size no less than one-quarter inch in thickness. The size and other characteristics of stem 6 would be dictated by the use to which auger 2 is to be put, and would be obvious to one skilled in the art. At the lower end of stem 6 is welded a box end fitting 7 with a failing male thread 8 to which a sub or coupler (not illustrated) having two female ends and a built-in check valve is to be connected. This check valve allows the one-way flow of water and drilling muds to the bit. The drill bit with its male end is connected to the other female end of the coupler. At the upper end of stem 6 is welded a box end fitting 9 with a failing female thread 10 to which a coupler (not illustrated) is attached so as to connect the first of the following lengths of drill steel 12 above the auger.

It is preferred that the smooth cylindrical exterior walls of the drill steel lengths 12 that make up the remainder of the drill string are sized to allow no more than one-quarter inch between the bore wall and the drill rod. The sizing, as well as the shape, effectively prevents them from disturbing the stabilized bore wall. The smooth rods 12 above the auger also provide that more torque can be delivered at the drill bit and auger 2 where it is needed.

The flighting 4 is made, for example, by winding around stem 6 a three-eighth inch by three-eighth inch bar which is then welded in place. A one-eighth inch bead of hard welding is then added to the top and sides of this bar.

The reference point for the beginning of the auger flighting is at the lower or male end 7, where the bit is to be connected. In order to apply the energy and forces that are involved in the operation of the drill rig in the most efficient manner, the number of flights and the angle of each flight is an important consideration in the present invention. Auger 2 is designed so that all the flights that are bringing material up the drill stem (right hand flights) have an angle of incline about 22.5° (with respect to the direction perpendicular to the longitudinal axis of the stem 6) and all the flights that are pushing material into the bore wall or down the drill stem (left hand flights) have an angle of incline of about 45°. This serves to conserve torque in the lifting process and allow the principle of leverage to do the work, while providing maximum forces for compressing tailings into the bore wall. Any deviations from these angles appear either to direct unproductive pressure downward or to allow material to move upward to easily because of the combination of the angle and the downward movement of the drill system. These angles also reduce the possibility of the auger becoming stuck in the hole. In particular, having regard to FIG. 1, there is illustrated an auger in accordance with the present invention of about ten feet in length. About one inch above male threaded box end 8 a two foot section A of right hand auger 14 begins. The size of the flighting for this section and all sections is about one-half inch high and one-half inch wide. At the two foot level on the stem, where the right hand auger 14 ends, at 180° around the stem, a two foot section B of left hand auger 16 begins. This separation is important so as not to create a wedge that would trap tailings or boulders during the clockwise rotation of auger 2. It should be remembered that during clockwise rotation of auger 2, right hand flights will tend to lift material and left hand flights will tend to push material down about the periphery of stem 6.

At the four foot level on the rod, where the left hand auger 16 ends, a one foot section C of right hand auger 18 begins, joined to the end of the left hand auger 16 to form a wedge 20 on the rod to divide material and force it up or into the wall. This wedge points in the direction of rotation of the auger. At the five foot level on stem 6, where the right hand flight ends, at 180° around the stem, a three foot section D of left hand flight 22 begins.

At the eight foot level on the stem, where the left hand flight 22 ends, a one foot section E of right hand auger 24 begins, joined to the end of left hand auger 22 to form a further wedge 26 on the stem. At the nine foot level on the stem, where the right hand flight 24 ends, at 180° around the stem, a one foot section F of left hand auger 28 begins. The left hand flight 28 stops about one inch below the top of the auger.

The angles and size of flighting 4 remain constant regardless of the diameter of stem 6 or length of auger 2. In the ten foot length illustrated, there is a total of four feet of right hand flighting and six feet of left hand flighting. For drilling holes larger than six inches in diameter twenty foot lengths of drill rod may for example be required, with the individual sections of right and left auger doubled in length proportionately.

Auger 2, which is placed on the drill stem directly after the bit and before the lengths of smooth rod 12 that make up the rest of the drill string, thereby achieves a number of specific functions in the drilling process:

(a) The initial section A of right hand auger 14 facilitates the quick removal of tailings from the drill bit, thus reducing wear on the drill bit.

(b) This initial section A directs the mixture of tailings and water away from the bit and into an even flow around and up the drill stem 6.

(c) Section B, with its left hand auger 16, the angle of its flight creating a distinctly sharper incline than that of right hand auger 14, has the effect of redirecting the upward flow of mud (mixture of water and cuttings) towards and into the bore hole wall.

(d) The shallow depth of both the right and left hand flighting controls the upward flow of water and tailings to allow optimum opportunity for the displacement of the mud mixture.

(e) The next short section C of right hand flight 18, which is joined to the top end of section B of left hand flight 16, has the effect of releasing the pressure caused by any materials not yet forced into the wall.

(f) The next adjacent long section D of left hand flight 22 completes the process of forcing the mud mixture into the bore hole wall if the wall can receive it.

(g) The short section E of right hand flight 24 following the long section D of left hand flight 22 has the effect of again releasing the pressure in the event that the bore wall is not porous enough to receive the mud mixture.

(h) The final short section F of left hand flight 28 forces into the wall any material that may drop down from the bore wall above as the drill descends. It also serves to maintain the bore wall surface as the drill stem 6 is rotated in the process of lifting and disconnecting drill rods.

The combination of the right and left hand flights, the latter with their distinctly sharper incline, allow for the very fine tailings that are created in the slower process of bedrock drilling, to work their way up to the surface without significant restraint. In the event there are openings or fissures in the bore wall they will be filled with the material from the hole but the major part will have to rise to the surface and is able to do so.

In the illustrated embodiment, the auger is designed for clockwise rotation. It will be understood however, that an auger designed for counterclockwise rotation would be constructed in a similar manner, but with the flight arrangements and angles reversed.

Thus it is apparent that there has been provided in accordance with the present invention an improved auger that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An auger for use in drilling into the earth under rotative movement in one direction of rotation, the auger having a cylindrical stem and a helical flight extending along the length of the stem, the helical flight being defined by adjacent segments of opposite flight orientation, the flight being broken 180° where it switches from one direction to the other and being joined to form a wedge in the direction of rotation when it switches from the other direction back to the first.

2. An auger according to claim 1 wherein the helical flighting of the auger alternates, along the length thereof, several times between right and left hand directions.

3. An auger according to claim 2 wherein the auger is intended for clockwise rotation and the flighting alternates from a right hand flight to a left hand flight a plurality of times from the lower end of the auger to its upper end.

4. An auger according to claim 3 wherein the flighting is broken 180° where it switches from right hand to left hand, and forms a wedge in the direction of rotation when it switches from left hand to right hand.

5. An auger according to claim 1 wherein the angle of incline of the flight with respect to the axis of the stem is distinctly sharper where the flight is oriented in a direction opposite to the intended direction of rotation of the auger than the angle of the flight which is oriented in the direction similar to the intended direction of rotation of the auger so as to limit the amount of tailings brought to the surface when the auger is in use on a drill string and to force the tailings into the bore wall to stabilize the bore from collapse.

6. An auger according to claim 5 wherein the angle of incline of the flight with respect to the axis of the stem is distinctly sharper where the flight is oriented in the left hand direction than the angle of the flight which is oriented in the right hand direction.

7. An auger according to claim 5 wherein the angle of incline of the flight having the sharper angle is about 45° and the angle of incline of the other flight is about 22.5°.

8. An auger according to claim 6 wherein the angle of incline of the left hand flight is about 45° and the angle of incline of the right hand flight is about 22.5°.

9. An auger according to claim 8 wherein the stem is about ten feet long.

10. An auger according to claim 9 wherein the flighting for all segments is about one-half inch high by one-half inch wide.

11. An auger according to claim 10 wherein the stem is made of hollow steel tubing having a uniform wall thickness of one-quarter inch or greater.

12. An auger according to claim 11 wherein the flighting extends along the stem as follows:

from about one inch above the thread of the lower box end of the auger, approximately a two foot section of right hand flight;

from about the two foot level starting 180° around the stem from where the right hand flight ends, to about the four foot level, a two foot section of left hand flight;

from about the four foot level where the left hand flight ends to about the five foot level, a one foot section of right hand flight;

from about the five foot level starting 180° around the stem from where the right hand flight ends, to about the eight foot level, a three foot section of left hand flight;

from about the eight foot level where the left hand ends to about the nine foot level, a one foot section of right hand flight; and from about the nine foot level starting 180° around the stem from where the right hand flight ends, a one foot section of left hand flight, this section ending about one inch below the upper end of the auger.

13. An auger according to claim 1 wherein the stem is of hollow steel and its lower end is provided with a box end fitting of hollow steel having a male thread to which a coupler with female sockets at both ends can be connected.

14. An auger according to claim 12 wherein the lower end of the stem is provided with a box end fitting of hollow steel having a male thread to which a coupler with female sockets at both ends can be connected.

15. An auger according to claim 14 in combination with a drill string extending from its top, the drill string made of one or more pipes having smooth cylindrical exterior walls.

16. An auger according to claim 9 wherein the stem is about twenty feet long.

17. An auger according to claim 16 wherein the flighting for all segments is about one-half inch high by one-half inch wide.

18. An auger according to claim 17 wherein the stem is made of hollow steel tubing having a uniform wall thickness of one-quarter inch or greater.

19. An auger according to claim 18 wherein the flighting extends along the stem, from about one inch above the thread of the lower box end of the auger to end at about one inch below the upper end of the auger, the flighting extending along the stem with a plurality of individual sections of alternating right and left hand flights, the total of the right hand flights being approximately eight feet in length and the total of the left hand flights being approximately twelve feet in length.

* * * * *